US008182317B1

(12) United States Patent
Ano

(10) Patent No.: US 8,182,317 B1
(45) Date of Patent: May 22, 2012

(54) HANDHELD SANDING IMPLEMENT

(76) Inventor: Harold Ano, Anaahola, HI (US)

( * ) Notice: Subject to any disclaimer, the term of this patent is extended or adjusted under 35 U.S.C. 154(b) by 840 days.

(21) Appl. No.: 12/258,079

(22) Filed: Oct. 24, 2008

(51) Int. Cl.
*B24D 15/04* (2006.01)

(52) U.S. Cl. ..... 451/524; 451/522; 451/508; 451/490

(58) Field of Classification Search ..... 451/360, 451/522–526, 508, 490, 559, 340–341, 358, 451/356; 15/143.1, 144.1, 142.1, 145
See application file for complete search history.

(56) References Cited

U.S. PATENT DOCUMENTS 2,645,064 A 7/1953 Pavlovic
3,483,662 A 12/1969 Ames
3,648,418 A 3/1972 Churchich
3,986,302 A * 10/1976 Biardi ..... 451/342
4,361,990 A 12/1982 Link
4,887,396 A 12/1989 Lukianoff
5,214,820 A * 6/1993 Shumway et al. ..... 15/118
5,279,080 A * 1/1994 Muller et al. ..... 451/525
D349,635 S 8/1994 Berti et al.
5,533,926 A 7/1996 Nemazi
D374,160 S 10/1996 Virost et al.
5,613,262 A 3/1997 Choy-Maldonado
5,735,864 A 4/1998 Heisinger, Jr.
6,629,331 B2 10/2003 Panfili et al.
7,179,152 B1 * 2/2007 Rhoades ..... 451/41

* cited by examiner

*Primary Examiner* — Dung Van Nguyen
(74) *Attorney, Agent, or Firm* — Kyle Fletcher

(57) ABSTRACT

A handheld sanding implement includes an elongated handle resembling a toothbrush handle upon a first end is mounted a sanding pad. The sanding pad is attached to said handle via an affixing means. The sanding pad may be replaced with a spinning head that includes a plurality of sanding pads containing a sanding surface having the same or differing grits.

15 Claims, 4 Drawing Sheets

HANDHELD SANDING IMPLEMENT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of sanding tools, more specifically, a handheld sanding tool that fits into tiny spaces that requires sanding.

B. Discussion of the Prior Art

As a preliminary note, it should be stated that there is an ample amount of prior art that deals with sanding tools. As will be discussed immediately below, no prior art discloses a handheld sanding implement that resembles a toothbrush and of which may have a plurality of sanding surfaces that rotate about a spinning head.

The Pavlovic patent (U.S. Pat. No. 2,645,064) discloses an abrading tool of which the end of the tool is comprised of an abrading surface that is secured to the tool via a clamp, see FIG. 3. However, the abrading tool does not have an elongated handle resembling that of a toothbrush, but rather a bulky handle. Furthermore, the abrading surface is secured to the tool via a clamp, as opposed to a sanding pad that is mounted upon the end of a handle by an affixing means comprising an adhesive.

The Ames patent (U.S. Pat. No. 3,483,662) discloses a sander with universal handle and lock. However, the sander is best suited for use with places of high elevation, such as the ceiling and not small spaces where a small tool would be best suited. Furthermore, the sander does not disclose a plurality of sanding surfaces that rotate about a spinning head.

The Churchich patent (U.S. Pat. No. 3,648,418) discloses a hand abrading tool that includes a bendable shaft upon which a sanding grit paper may wrap about and be secured via a clamp mounted upon the handle. However, the abrading tool does not resemble a toothbrush and thereby is not best suited for sanding hard to reach spaces wherein a sanding implement of said size would be best suited. Furthermore, the abrading tool does not disclose a plurality of sanding surfaces that rotate about a spinning head.

The Link patent (U.S. Pat. No. 4,361,990) discloses a sandpaper holder that includes a handle having a pair of slots through which a sanding belt or strip passes in order to secure said belt or strip to the handle. However, the handle does not resemble a toothbrush handle and have a sanding pad mounted thereon. Furthermore, the sander does not disclose a plurality of sanding surfaces that rotate about a spinning head.

The Choy-Maldonado patent (U.S. Pat. No. 5,613,262) discloses a lingual brush that is suited for cleaning the surface of the tongue comprising an elongated handle. However, the handle is not outfitted with a sanding pad to sand objects or surfaces located in tight spaces.

The Heisinger, Jr. patent (U.S. Pat. No. 5,735,864) discloses a disposable tongue cleaner that includes a handle having a textured surface suited for cleaning a tongue. However, the tongue cleaner is not equipped with a sanding pad for sanding an object or surface that is located in a tight space. Furthermore, the tongue cleaner does not disclose a plurality of sanding surfaces that rotate about a spinning head.

The Panfili et: al. patent (U.S. Pat. No. 6,629,331) discloses an ergonomic hand scraper that includes an elongated handle and scraper. However, the handle is not similar in size to that of a toothbrush, but rather employs the use of both hands when scraping a surface. Furthermore, the scraper does not disclose a plurality of sanding surfaces that rotate about a spinning head.

While the above-described devices fulfill their respective and particular objects and requirements, they do not describe a handheld sanding implement that involves an elongated handle with a sanding pad mounted at a first distal end wherein said sanding pad may be substituted with a spinning head including a plurality of sanding pads. In this regard, the handheld sanding implement departs from the conventional concepts and designs of the prior art.

SUMMARY OF THE INVENTION

A handheld sanding implement includes an elongated handle resembling a toothbrush handle upon a first end is mounted a sanding pad. The sanding pad is attached to said handle via an affixing means. The sanding pad may be replaced with a spinning head that includes a plurality of sanding pads containing a sanding surface having the same or differing grits.

An object of the invention is to provide a handheld sanding implement that is the size of a toothbrush.

A further object of the invention is to provide a handheld sanding implement that is either disposable or reusable.

A further object of the invention is to provide a handheld sanding implement that may have a spinning head upon which a plurality of sanding surfaces is located, and of which may include similar or dissimilar sanding grits.

These together with additional objects, features and advantages of the handheld sanding implement will be readily apparent to those of ordinary skill in the art upon reading the following detailed description of presently preferred, but nonetheless illustrative, embodiments of the handheld sanding implement when taken in conjunction with the accompanying drawings.

In this respect, before explaining the current embodiments of the handheld sanding implement in detail, it is to be understood that the handheld sanding implement is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the handheld sanding implement. It is therefore important that the claims be regarded as including such equivalent construction insofar as they do not depart from the spirit and scope of the handheld sanding implement. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
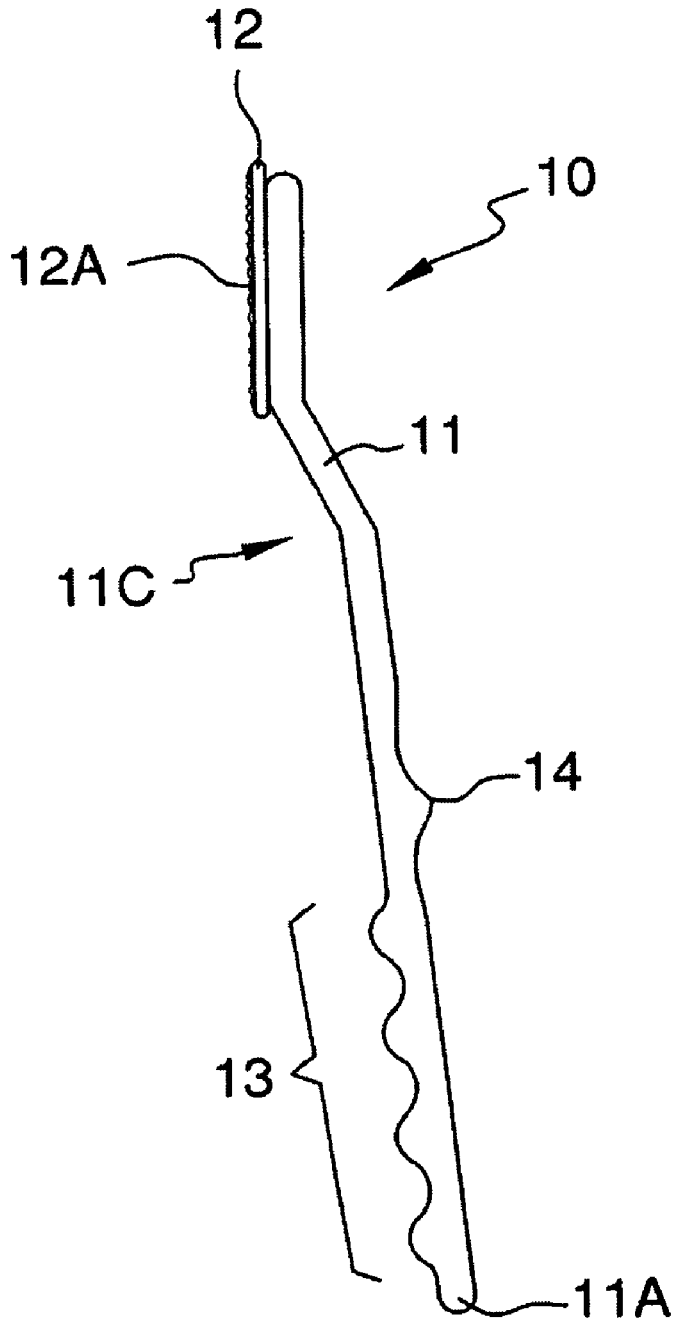
FIG. 1 illustrates a side view of the handheld sanding implement.
Figure 2:
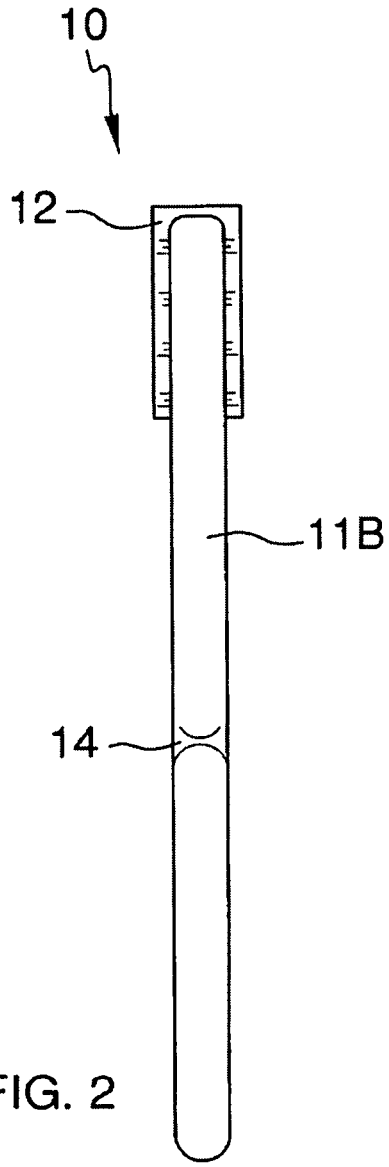
FIG. 2 illustrates a rear view of the handheld sanding implement.
Figure 3:
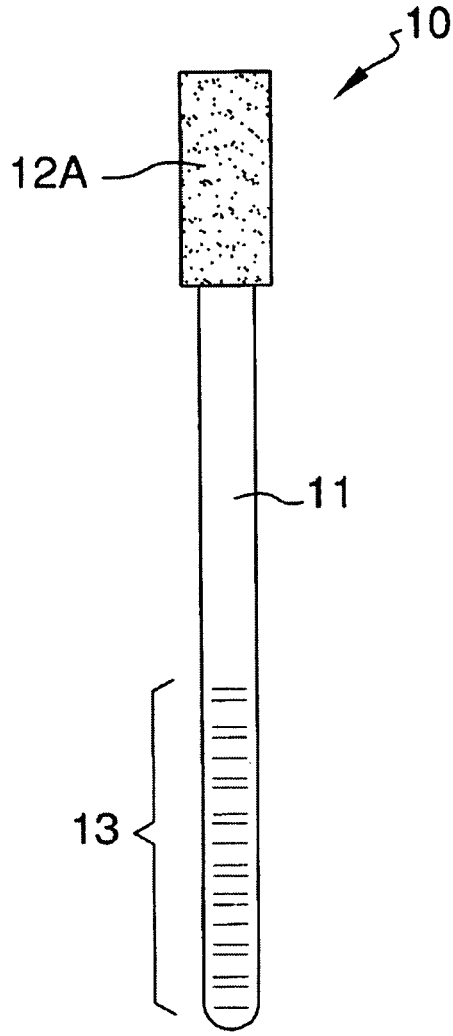
FIG. 3 illustrates a front view of the handheld sanding implement.
Figure 4:
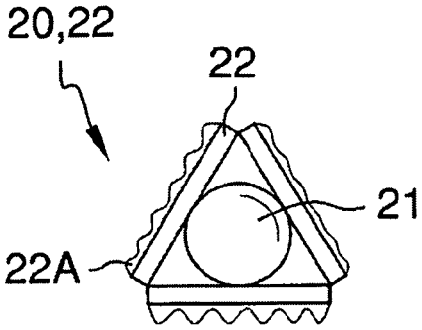
FIG. 4 illustrates a top view of the spinning head embodiment.
Figure 6:
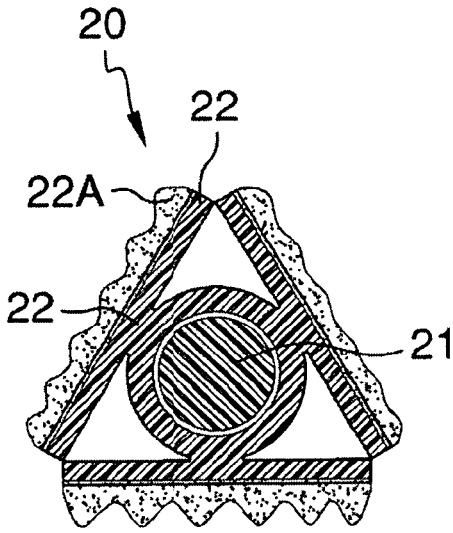
FIG. 6 illustrates a cross-sectional view of the spinning head embodiment along line 6-6 in FIG. 5.
Figure 5:
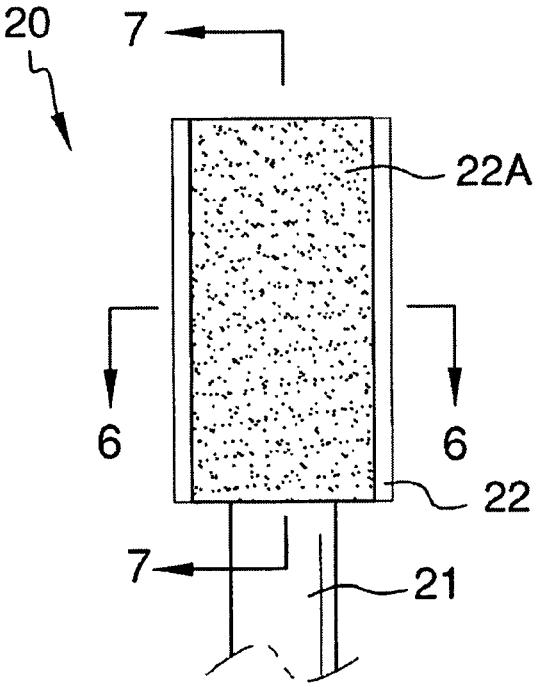
FIG. 5 illustrates a close up front view of the spinning head embodiment.
Figure 7:
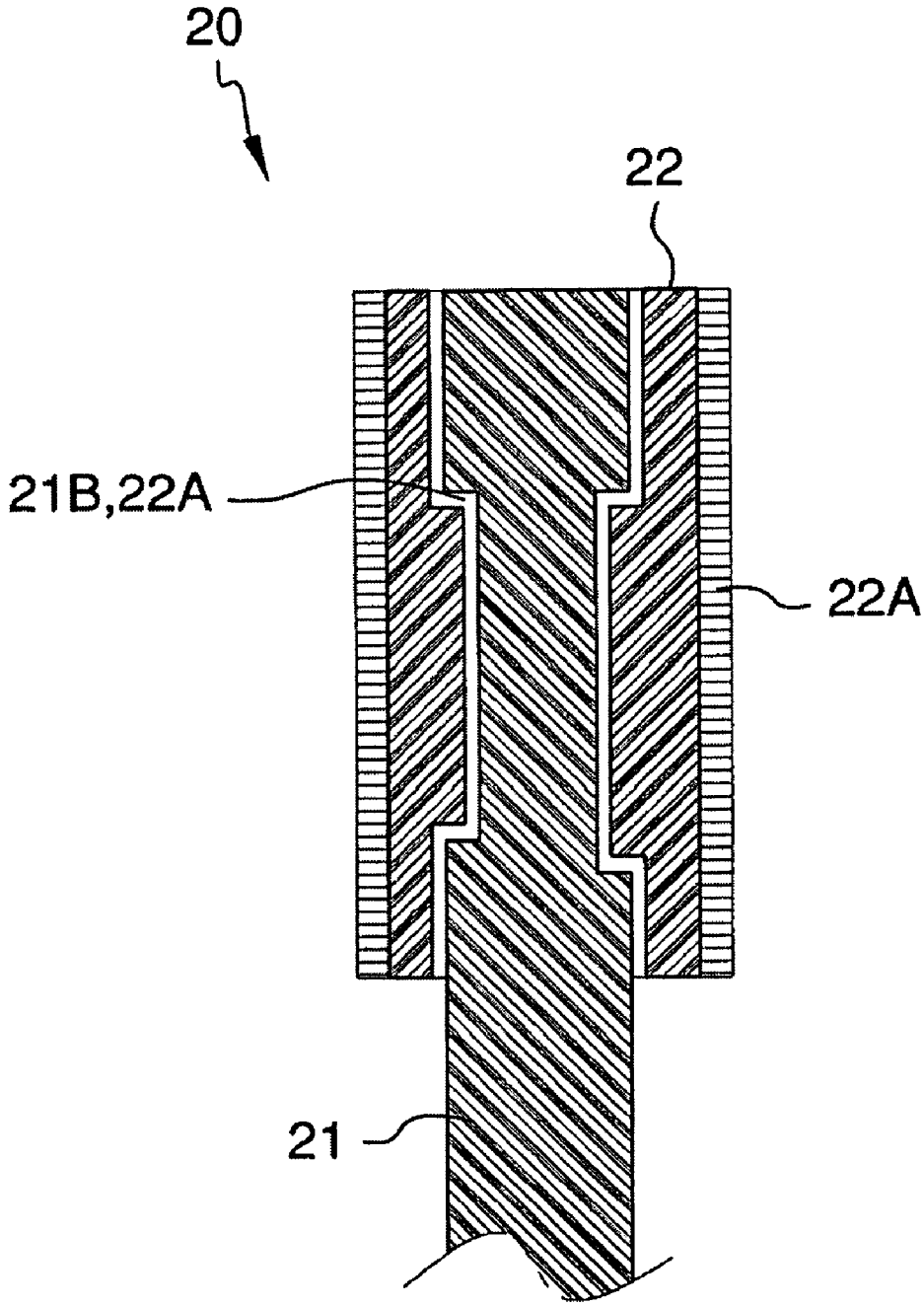
FIG. 7 illustrates a cross-sectional view of the spinning head embodiment along line 7-7 in FIG. 5.

Detailed reference will now be made to the preferred embodiment of the present invention, examples of which are illustrated in FIGS. 1-3. A handheld sanding implement 10 (hereinafter invention) includes an elongated handle 11 and a sanding pad 12.

The elongated handle 11 resembles a toothbrush handle (not depicted, but well known in the art). The size of the handle 11 is important to the overall benefit of the invention 10, which is to provide a handheld sanding implement that can sand in tight spaces.

The handle 11, as depicted, includes a plurality of finger grooves 13 along a first distal end 11A of the handle 11. The finger grooves 13 are included as a means of providing an ergonomic grip that further insures that the handle 11 does not move while the invention 10 is in use. It shall be noted that the handle 11 may be designed without such finger grooves 13.

The handle 11, as depicted, also includes a thumb groove 14 along a rear surface 11B of the handle 11. The thumb groove 14 is included as a means of insuring that the handle 11 does not slip when the invention 10 is in use. It shall also be noted that the handle 11 may be designed without such thumb groove 14. It shall also be noted that the thumb groove 14 may be included on the surface of the handle 11 minus the finger grooves 13.

Also note that the handle 11 has an angle 11C on the handle 11, which provides a mechanical advantage over a straight handle (not depicted).

The handle 11 may be made of a material comprising a plastic, wood, or a metal. Whereas, the sanding pad 12 includes a strip of sanding paper 12A or is coated with a sanding grit on the surface of the sanding pad 12. The sanding pad 12 may be made of a material comprising a plastic, wood, or metal.

The sanding pad 12 is attached to a second distal end 11D of the handle 11 by an affixing means comprising welding, adhesive, molding the two parts together, or crimping the two parts together.

Now referring to FIGS. 4-7, a spinning head embodiment 20 (hereinafter alternative embodiment) includes a handle 21, and a spinning head 22. The handle 21 has an angle (not depicted), such as the angle 11C of the handle 11 mentioned above.

The elongated handle 21, like the handle 11 in the invention 10 mentioned above, resembles a toothbrush handle (not depicted, but well known in the art). The size of the handle 21 is again important to the overall benefit of the alternative embodiment 20, which is to provide a handheld sanding implement that can sand in tight spaces with a plurality of different sanding surfaces of similar or dissimilar sanding grits.

The handle 21, not as depicted, includes a plurality of finger grooves (not depicted) along a first distal end (not shown) of the handle 21. The finger grooves (not depicted) are included as a means of providing an ergonomic grip that further insures that the handle 21 does not move while the alternative embodiment 20 is in use. It shall be noted that the handle 21 may be designed without such finger grooves (not depicted).

The handle 21, not as depicted, also includes a thumb groove (not depicted) along a rear surface of the handle 21. The thumb groove (not depicted) is included as a means of insuring that the handle 21 does not slip when the alternative embodiment 20 is in use. It shall also be noted that the handle 21 may be designed without such thumb groove (not depicted). It shall also be noted that the thumb groove (not depicted) may be included on the surface of the handle 21 minus the finger grooves (not depicted).

The handle 21 may be made of a material comprising a plastic, wood, or a metal.

The spinning head 22 includes a plurality of sanding surfaces 22A that rotate about a second distal end 21A of the handle 21. The spinning head 22 is secured about the handle 21 by a groove 21B located on the handle 21 and a groove 22A located on the spinning head 22 such that the spinning head 22 is capable of spinning about the handle 21. The alternative embodiment 20 also includes a locking means (not depicted), which enables the spinning head 22 to be locked with respect to the handle 21 such that when the alternative embodiment 20 is in use, the spinning head 22 does not move with respect to the handle 21.

The spinning head 22, as depicted, includes three different sanding surfaces 22B. Each sanding surface 22B is covered with a sanding paper strip or coated with a sanding grit. It shall be noted that the spinning head 22 may have a plurality of sanding surfaces 22B, and not limited to 3 distinct sanding surfaces 22B. It shall be noted that the sanding surfaces may have a sanding strip attached to the surface via an adhesive, and that a sanding grit maybe affixed to the sanding surface 22B via an adhesive. It shall also be noted that the sanding surfaces 22B may have the same or different grits on each surface.

The spinning head 22 may be made of a material comprising a wood, metal, or plastic.

It is envisioned that the invention 10 and the alternative embodiment 20 maybe used at a disposable faculty or be re-usable wherein replacement sanding strips maybe attached to the corresponding sanding surface(s).

With respect to the above description, it is to be realized that the optimum dimensional relationship for the various components of the invention 10 and the alternative embodiment 20, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10 and the alternative embodiment 20.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A handheld sanding implement comprising:

(a) a handle;

wherein the handle is elongated;

wherein the handle has a plurality of finger grooves at a first distal end of the handle;

(b) a spinning head;

wherein the spinning head is attached to a second distal end of the handle by a grooved notch in both the handle and the spinning head, and of which enables the spinning head to rotate about the handle;

wherein the spinning head has a plurality of sanding pads;

wherein each sanding pad has a sanding surface.

2. The hand-held sanding implement as described in claim 1 wherein the handle has a thumb groove.

3. The hand-held sanding implement as described in claim 1 wherein the handle has an angle located between a first distal end and the second distal end.

4. The hand-held sanding implement as described in claim 3 wherein the handle has a thumb groove.

5. The hand-held sanding implement as described in claim 1 wherein the handle has a thumb groove.

6. The hand-held sanding implement as described in claim 1 wherein the handle and the spinning head are made of a material comprising a plastic, wood, or a metal.

7. A handheld sanding implement comprising:

(a) a handle;

wherein the handle is elongated;

(b) a spinning head;

wherein the spinning head is attached to a second distal end of the handle by a grooved notch in both the handle and the spinning head, and of which enables the spinning head to rotate about the handle;

wherein the spinning head has a plurality of sanding pads; and wherein each sanding pad has a sanding surface.

8. The hand-held sanding implement as described in claim 7 wherein the handle has a plurality of finger grooves at a first distal end of the handle.

9. The hand-held sanding implement as described in claim 8 wherein the handle has a thumb groove.

10. The hand-held sanding implement as described in claim 7 wherein the handle has a thumb groove.

11. The hand-held sanding implement as described in claim 7 wherein the handle has an angle located between a first distal end and the second distal end.

12. The hand-held sanding implement as described in claim 11 wherein the handle has a plurality of finger grooves at the first distal end of the handle.

13. The hand-held sanding implement as described in claim 12 wherein the handle has a thumb groove.

14. The hand-held sanding implement as described in claim 11 wherein the handle has a thumb groove.

15. The hand-held sanding implement as described in claim 7 wherein the handle and the sanding pad are made of a material comprising a plastic, wood, or a metal.

* * * * *